United States Patent [19]

Hertel

[11] 4,082,503

[45] Apr. 4, 1978

[54] PROCESS FOR THE PRODUCTION OF WATER-INSOLUBLE AZO DYESTUFFS ON THE FIBER

[75] Inventor: Hasso Hertel, Muhlheim am Main, Germany

[73] Assignee: Hoechst Aktiengesellschaft, Frankfurt am Main, Germany

[21] Appl. No.: 711,164

[22] Filed: Aug. 3, 1976

[30] Foreign Application Priority Data

Aug. 5, 1975 Germany ..... 2534870

[51] Int. Cl.[2] ..... C09B 27/00

[52] U.S. Cl. ..... 8/44; 8/46; 8/51; 8/54.2; 8/82

[58] Field of Search ..... 8/44, 46, 82, 51

[56] References Cited

U.S. PATENT DOCUMENTS 2,178,744 11/1939 Ellis et al. ..... 8/24

3,288,552 11/1966 Streck ..... 8/44

3,697,216 10/1972 Hertel et al. ..... 8/46

FOREIGN PATENT DOCUMENTS 2,433,232 1/1976 Germany.

OTHER PUBLICATIONS

L. Diserens, "The Chemical Technology of Dyeing and Printing" (Reinhold, New York, 1948) p. 255.

*Primary Examiner*—A. Lionel Clingman

*Attorney, Agent, or Firm*—Connolly and Hutz

[57] ABSTRACT

It had been found that boric acid can advantageously be used as a buffer and neutralization agent in the developing bath containing the azonium compound in a process for the preparation of water-insoluble azo dyestuffs on the fiber according to the ice-color technique, thus avoiding ecological problems with regard to the waste water obtained in the dyeing process.

1 Claim, No Drawings

PROCESS FOR THE PRODUCTION OF WATER-INSOLUBLE AZO DYESTUFFS ON THE FIBER

The present invention provides an improved process for the production of water-insoluble azo dyestuffs on the fiber according to the methods of the ice color technique.

As has been already known, the production of water-insoluble azo dyestuffs on the fiber is effected by reacting a diazonium compound with a coupling component. The process is carried out in a way that the coupling component is first applied onto the textile material from a caustic alkaline bath, and the textile goods thus treated are then placed into another bath containing the diazonium compound, in which the dyestuff is formed. In order to yield dyeings of a high tinctorial strength and a good fastness to rubbing, the azo coupling has to be performed in a slightly acid to slightly alkaline range, depending on the kind of the components used.

Therefore, the baths containing the diazonium compound must contain agents which bind the alkali adherent to the textile material and which maintain the desired pH range by buffering. Besides showing a high buffering capacity, they are required to have a good compatibility with the components used. In practice there are used, for example, acetic acid/sodium acetate, mono-/disodium phosphate, chromium acetate, zinc sulfate, and aluminium sulfate (cf. Ullmanns Enzyklopadie der techn. Chemie, 3rd edition, vol 7, page 23; HOECHST AG, Naphtol AS-Anwendungsvorschriften).

Of these, only mono-/disodium phosphate and chromium acetate are appropriate for working in the neutral and slightly alkaline media, however, these substances are not unobjectionable from the ecological point of view.

The present invention provides an improved process for the production of water-insoluble azo dyestuffs on the fiber according to the ice-color technique in which the coupling component is at first applied from an alkaline bath onto the textile material, preferably cellulose-containing textile material, and the said textile goods are then treated in an acid developing bath containing the diazonium compound, which comprises using for the development of the dyeing goods a developing bath which also contains boric acid.

Boric acid is an appropriate alkali binding and buffering substance for dyeing according to the ice color technique in the neutral and slightly alkaline range. Said acid is well compatible with the diazonium salt solutions and partly even shows a stabilizing effect. Besides, it has a great buffering capacity and is less objectionable from the ecological point of view than the two above-mentioned buffer media.

Boric acid may be used as an alkali binding agent and buffering substance for all diazonium and tetrazonium salt solutions which are common in the ice color dyeing, for example azonium salts of chloroanilines, nitranilines, anisidines, chlorotoluidines, chloroanisidines, chloronitranilines, trifluoromethylanilines, of aniline-, toluidine-, as well as anisidine-sulfonic acid-mono- and -dialkylamides with lower alkyl groups, of toluidine- and anisidine-carboxylic acid amides, of p-aminodiphenylamine and the methoxy derivatives thereof, of acylaminoanilines with an acylamino radical of an aliphatic or aromatic carboxylic acid, of these, in particular of benzoylaminoanilines which may be substituted in the benzene necleus by halogen, for example chlorine, and/or by lower alkyl and/or lower alkoxy groups, of aminoazobenzenes which may be substituted by halogen, such as chlorine, lower alkyl, lower alkoxy or nitro groups or be also substituted by aminophenylamino radicals, as well as those of o-tolidine and of o-dianisidine. By the term of "lower" there are to be understood those radicals which contain an alkyl radical of from 1 to 5 carbon atoms.

The process is particularly suitable for the use of diazonium salt solutions of amines of the formulae

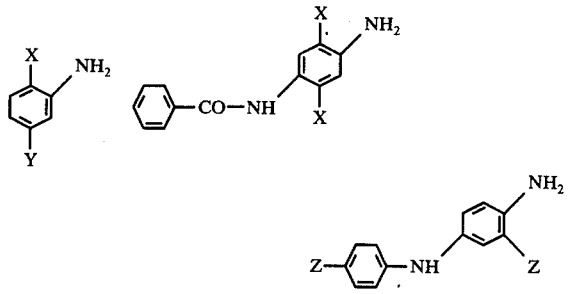

In which X may be the same or different and each represents a methyl or methoxy group, Y stands for a chlorine atom, a nitro, a sulfonic acid-mono-($C_1$–$C_4$-alkyl)amide, a sulfonic acid-di-($C_1$–$C_4$-alkyl)-amide or the carboxylic acid-amide group, and Z represents a hydrogen atom or a methoxy group, in particular of the diazonium salt solutions of 4-chloro-2-amino-anisol, 4-nitro-2-amino-toluene, 5-nitro-2-amino-anisol, 2-amino-anisol-4-sulfonic acid-diethylamide, 2-amino-anisol-4-carboxylic acid-amide, 4-amino-2',3-dimethyl-azobenzene, 4-benzoylamino-2,5-diethoxy-aniline, 2-amino-5-benzoylamino-4-methyl-anisol, 4-chloro-2-amino-5-benzoylamino-toluene, 4-amino-diphenyl-amine, 4'-amino-4-methoxy-diphenylamine, and 4-amino-3-methoxy-diphenylamine, as well as of tetrazonium salt solutions of o-dianisidine, 4,4'-diamino-diphenylamine and 4'-(4''-aminophenylamino)-4-amino-6-ethoxy-3-methyl-azobenzene (cf. for example, Colour Index, 3rd edition (1971), No. 37,000 – 37,275).

The preparation of the diazonium or tetrazonium solutions is carried out according to known methods. Information on this subject may be found, for example, in K. Holzach, Die Diazoverbindungen, Stuttgart (1947), or in Ullmanns Enzyklopadie der techn. Chemie, 3rd edition, vol. 5, pages 791 et seq. (and further literature indicated therein).

As coupling components there may be mentioned for the process of the invention those components which are commonly used in the ice color technique (cf. Colour Index, 3rd edition (1971), C.I. 37,505 – 37,625).

Particularly suitable are arylamides of aromatic and heterocyclic o-hydroxycarboxylic acids of the general formulae

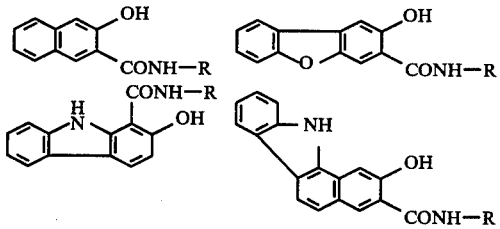

in which R stands for the phenyl radical optionally substituted by — preferably 1 or 2 — substituents of the group consisting of halogen, such as chlorine or bromine, lower alkyl and lower alkoxy.

Boric acid may be used, according to the invention, in a high, medium and low goods-to-liquor ratio as well as in the batchwise exhaustion and the pad dyeing processes. The amounts of boric acid used depend upon the amount of alkali introduced together with the material into the developing bath, and are in the range of from about 200 to 1,000 molar percent, calculated on the diazonium salt used.

The dyeings prepared according to the process of the invention are distinguished by good color yields, good evenness and favorable fastness properties.

The following Examples serve to illustrate the invention, the parts being parts by weight.

EXAMPLE 1

A mixture of 3.4 parts of ethanol, 4 parts of water, 1.4 parts of an aqueous 32% sodium hydroxide solution and 2 parts of 33% formaldehyde was poured over 2 parts of 2-hydroxynaphthalene-3-carboxylic acid-(4'-chloro-2'-methyl-phenyl-1')-amide, and the mixture was dissolved, while stirring. After 10 minutes this solution was introduced into 1,000 parts of water which contained 13 parts of an aqueous 32% sodium hydroxide solution and 2 parts of a fatty acid-protein degradation product-condensate. Subsequently 50 parts of bleached, boiled and wetted-out cotton yarn were placed into the solution prepared and were treated for 30 minutes, while being moved well in the bath. The yarn was then taken out, was well centrifuged and placed into a bath which had been prepared as follows: 2.25 Parts of 5-amino-2-benzoylamino-1,4-diethoxy-benzene were stirred together with 45 parts of water, 2.1 parts of 32% hydrochloric acid were added, and the mixture was diazotized at about 15° C with 0.52 part of sodium nitrite in a concentrated aqueous solution. The excess acid was eliminated by adding 0.06 part of magnesium oxide; after having added 1.5 parts of a polyethylene glycolether and 1.6 parts of boric acid, the mixture was filled up with water to give a total of 1,000 parts.

In this bath the textile material introduced was treated for 30 minutes, was taken out, rinsed as usual, soaped and dried. A blue dyeing was obtained in a good color yield which showed good fastness properties.

EXAMPLE 2

In order to produce a bordo dyeing on cotton yarn, a wetted-out cross-wound bobbin with 500 parts of cotton yarn with at first treated in a dyeing apparatus with 5,000 parts of a dye bath which contained 12.5 parts of 2-hydroxynaphthalene-3-carboxylic acid-(4'-chlorophenyl-1')-amide, 54 parts of an aqueous 32% sodium hydroxide solution, 6 parts of 33% formaldehyde and 15 parts of a common protective colloid.

After 30 minutes this bath was pumped off, and the goods were rinsed intermediately for 8 minutes with a solution containing 150 parts of sodium chloride and 5 parts of an aqueous 33% sodium hydroxide solution in 5,000 parts by volume of water. After this bath had been pumped off, the goods were treated for 30 minutes with a dye bath which had been prepared as follows: 15 Parts of 4-chloro-2-amino-5-benzoylamino-toluene were stirred together with 300 parts of water, and after the addition of 20 parts of 32% hydrochloric acid the mixture was diazotized with 4 parts of sodium nitrite in a concentrated aqueous solution at 10° C. By introducing 4.5 parts of sodium bicarbonate, the excess acid was eliminated; subsequently 10 parts of boric acid and 7.5 parts of a polyethylene glycolether were added, and the mixture was filled up with water to give 5,000 parts.

After the dyeing process, the goods were rinsed as usual, were soaped first at 60° C and then at 100° C, then clear-rinsed and dried.

EXAMPLE 3

In order to produce a red dyeing on cotton, a cotton fabric was padded with a solution of 12.5 parts of 2-hydroxynaphthalene-3-carboxylic acid-phenylamide (Colour Index No. 37,505), 17 parts of an aqueous 32% sodium hydroxide solution and 5 parts of a commercial dyeing and level-dyeing auxiliary agent on the basis of a fatty acid-protein degradation product-condensate in 1,000 parts of water, with a liquor pick-up of 80% by weight calculated on the fabric. The goods which had then been dried, were padded over with another padding liquor of room temperature in a second padder, the liquor pick-up being also 800 g per kg of fabric. This second padding liquor had been prepared as follows: 10 Parts of 2-amino-anisol-4-carboxylic acid-amide were stirred together with 100 parts of water. After having added 19.5 parts of 32% hydrochloric acid and a small amount of ice, the mixture was diazotized at a temperature not exceeding 15° C with 4.3 parts of sodium nitrite in a concentrated aqueous solution. After 4 parts of sodium acetate, 18 parts of boric acid and 2 parts of a polyethylene-glycolether had been added, the solution was filled up with water to 1,000 parts.

After padding, an air passage of about 1 minute followed, and thereafter a hot water passage. Subsequently the goods were washed, soaped, rinsed and dried as usual.

EXAMPLE 4

If the process was carried out according to the method described in Example 1, however, while using an impregnation bath containing in 1,000 parts 1.5 parts of 2-(3'-hydroxydiphenylene oxide-2'-carbonylamino)-1,4-dimethoxy-benzene, 3 parts of ethanol, 13 parts of 32% sodium hydroxide solution and 3 parts of a fatty acid-protein degradation product-condensate, and a developing bath containing in 1,000 parts 1.8 parts of diazotized 5-nitro-2-amino-toluene, 1.5 parts of boric acid and 1.5 parts of a polyethylene-glycolether, a brown dyeing was obtained in a good color yield, which showed good fastness properties.

EXAMPLE 5

In order to produce a black dyeing on cotton fabric, an undyed cotton fabric was impregnated with an impregnation bath according to the method described in Example 3 and, after an intermediate drying, was padded over with a liquor pick-up of 800 g/kg of material with a padding-liquor which contained in 1,000 parts the tetrazonium compound from 11 parts of 4'-(4''-aminophenylamino)-4-amino-6-ethoxy-3-methyl-azobenzene, 18 parts of boric acid and 2 parts of a polyethylene-glycolether. An air passage of about 1 minute and a hot water passage followed. Subsequently the goods were washed, soaped, rinsed and dried as usual.

EXAMPLE 6

In order to produce a voilet dyeing of cotton yarn on cross-wound bobbins, the process as mentioned in Example 2 was carried out, however, with the individual baths being composed as follows: The impregnation bath contained in 5,000 parts 20 parts of 2-hydroxynaphthalene-3-carboxylic acid-(3'-nitro-phenyl-1')-amide, 54 parts of an aqueous 32% sodium hydroxide solution, 10 parts of formaldehyde and 15 parts of a common protective colloid; the developing bath consisted of 5,000 parts of an aqueous solution of 17 parts of diazotized 6-amino-4-benzoylamino-1,3-dimethoxy-benzene, 14 parts of boric acid and 7.5 parts of a polyethylene-glycolether.

EXAMPLE 7

In order to produce a blue dyeing on cotton fabric, an undyed cotton fabric was treated with a bottoming (impregnation) bath as has been described in Example 3 and was padded over, after an intermediate drying, with a liquor pick-up of 800 g/kg of material with a bath containing in 1,000 parts the diazonium compound from 10.5 parts of 4'-amino-4-methoxy-diphenylamine, 17.5 parts of boric acid and 3 parts of an octadecylpolyglycolether having an average molecular weight of 1,000. An air passage of about 1 minute followed, and the fabric was placed into a full width washing machine. In the first compartment a hot water passage was effected (70° - 80° C with overflow), in the second the material was rinsed at 60° C, and in the third to the sixth it was soaped at boiling temperature with 1 part each of sodium carbonate, sodium tripolyphosphate and nonylphenol polyglycolether dissolved in 1,000 parts of water, in the seventh compartment the goods were rinsed with warm water, and in the eighth they were rinsed with cold water. Subsequently they were dried on a pin stenter.

EXAMPLE 8

In order to obtain a red-brown dyeing on cotton yarn, a wetted-out cross-wound bobbin with 500 parts of cotton yarn was treated in a dyeing apparatus at first with 5,000 parts of a dye bath which contained 8.5 parts of 2-hydroxynaphthalene-3-carboxylic acid-(4'-chloro-2',5'-dimethoxyphenyl-1')-amide, 41 parts of an aqueous 32% sodium hydroxide solution, 100 parts of sodium chloride, 6 parts of 33% formaldehyde and 15 parts of a common protective colloid.

After 30 minutes this liquor was pumped off, and the goods were subjected to an intermediate rinsing process for 8 minutes using a solution of 150 parts of sodium chloride and 5 parts of an aqueous 33% sodium hydroxide solution in 5,000 parts by volume of water.

After this bath had been pumped off, the material was treated for 30 minutes with a dyeing bath which had been prepared as follows: 15 Parts of 90% 5-amino-2-benzoylamino-4-methoxy-toluene were stirred together with 300 parts of water and 5 parts of octadecylpolyglycolether (having an average molecular weight of 1,500), and after 20 parts of 32% hydrochloric acid had been added, the mixture was diazotized with 4.5 parts of sodium nitrite in a concentrated aqueous solution at 10° C. By introducing 5.5 parts of sodium bicarbonate, the excess acid was eliminated; subsequently 8 parts of boric acid were added and the mixture was made up to 5,000 parts with water. Subsequently the goods were rinsed as usual, were saponified first at 60° C, then at 100° C, then clear-rinsed and dried.

EXAMPLE 9

20.0 Parts of 2-oxy-3-naphthoic acid-2'methylanilide were introduced by stirring into a solution which had a temperature of 90° C and contained 27 parts of an aqueous 33% sodium hydroxide solution and 5 parts of a protein degradation product-fatty acid-condensate in 1,000 parts of water, and dissolved therein by boiling. Subsequently a cotton fabric was padded with a liquor pick-up of 800 g/kg. The goods were dried on a stenter frame and padded over an a second padder with a dyeing bath having a temperature of about 10° C, which had been prepared as follows: 18 Parts of a 90% 6-chloro-2-amino-toluene-chlorohydrate were stirred together with a mixture of 1.8 parts of octadecylpolyglycolether and 360 parts of ice water. After 21 parts of hydrochloric acid (of 32% strength) had been added, 7 parts of sodium nitrite dissolved in a small amount of water were slowly added. After the diazotization had been completed, the mixture was diluted with water to give 1,000 parts, the excess hydrochloric acid was neutralized by introducing 7.5 parts of sodium bicarbonate, and 30 parts of boric acid were added as buffering substance. After an air passage of about 1 minute, the goods were washed in a full width washing machine, as has been described in Example 7. A red-orange dyeing was obtained.

EXAMPLE 10

The development of the fabric impregnated according to the method described in Example 9 could also be effected on a jig and was carried out as follows: The diazo solution prepared according to Example 9 containing 18 parts of 90% 6-chloro-2-amino-toluene-chlorohydrate was diluted after the addition of sodium bicarbonate and boric acid with water to a volume of 2,400 parts, and 120 parts of sodium chloride were dissolved therein. 800 Parts of impregnated fabric were developed with this amount of liquor on a jig in the course of 4 passages. Subsequently the goods were acidified as usual (two passages with 3 ml/l of 32% hydrochloric acid), then clear-rinsed (with overflow, two passages), soaped while being warm (60° C, 4 passages, 1 g/l each of nonylphenol-polyglycolether, sodium carbonate and sodium tripolyphosphate), rinsed in warm water (2 passages), soaped in the hot state (95° C, 4 passages same bath as above) and clear-rinsed.

EXAMPLE 11

If the process was carried out as has been described in Example 9 above, however, while using 19.6 parts of 2-amino-toluene-4-sulfonic acid-dimethylamide and 31 parts of hydrochloric acid instead of 18 parts of 90% 6-chloro-2-amino-toluene-chlorohydrate and 21 parts of hydrochloric acid, a red dyeing was obtained.

EXAMPLE 12

If the process was carried out as has been described in Example 1 above, however, an impregnation bath of 1.3 parts of 2-oxy-11 H-benzo(a)carbazol-3-carboxylic acid-4'-methoxyphenylamide, 2.2 parts of ethanol, 0.7 part of formaldehyde, 13 parts of 23% sodium hydroxide solution and 3 parts of a fatty acid-protein degradation product-condensate per 1,000 parts and a developing bath of 1.6 parts of diazotized 5-nitro-2-amino-anisol, 2.5 parts of boric acid and 1.5 parts of a polyethylene-glycolether per 1,000 parts were used, a black dyeing was obtained in a good color yield and with good fastness properties.

I claim:

1. A process for the preparation of a water-insoluble azo dyestuff on cellulose fiber according to the ice-color technique, which comprises using for the developing of the dyeing goods treated with the alkali metal salt of a coupling component in the neutral or slightly alkaline range, a developing bath with the diazonium compound which also contains boric acid.

* * * * *